US005813831A

United States Patent [19]

Matsunaga et al.

[11] Patent Number: 5,813,831

[45] Date of Patent: Sep. 29, 1998

[54] CENTRIFUGAL BLOWER HAVING A BELL-MOUTH RING FOR REDUCING NOISE

[75] Inventors: Kouji Matsunaga, Kariya; Koji Ito, Nagoya; Teruhiko Kameoka, Okazaki; Kazutoshi Kuwayama, Nakashima-gun, all of Japan

[73] Assignee: Denso Corporation, Kariya, Japan

[21] Appl. No.: 813,460

[22] Filed: Mar. 10, 1997

[30] Foreign Application Priority Data

Mar. 11, 1996 [JP] Japan ..... 8-053351

[51] Int. Cl.[6] ..... F04D 29/44

[52] U.S. Cl. ..... 415/173.6; 415/204; 415/206; 415/208.1; 415/211.1

[58] Field of Search ..... 415/119, 204, 415/206, 173.6, 172.1, 173.1, 208.1, 211.1; 416/186 R

[56] References Cited

U.S. PATENT DOCUMENTS

| | | | |
|---|---|---|---|
| 1,149,638 | 8/1915 | Davidson | 415/211.1 |
| 3,306,528 | 2/1967 | Eck | 416/186 R |
| 4,432,694 | 2/1984 | Kuroda et al. | 415/172.1 |
| 5,352,089 | 10/1994 | Tokunaga et al. . | |
| 5,511,939 | 4/1996 | Tokunaga et al. . | |

FOREIGN PATENT DOCUMENTS

| | | | |
|---|---|---|---|
| 2209118 | 9/1973 | Germany | 415/119 |
| 63-215899 | 9/1988 | Japan | 415/211.1 |
| 2063365 | 6/1981 | United Kingdom | 415/206 |

*Primary Examiner*—Christopher Verdier
*Attorney, Agent, or Firm*—Harness, Dickey & Pierce, PLC

[57] ABSTRACT

A bell-mouth ring is formed with a casing to be disposed proximately at an outer radial side of a shroud. The bell-mouth ring has a deflection wall surface for deflecting a flow of air blown out radially outwardly from the centrifugal multi-blade fan and further flowing radially inwardly toward the rotation axis along an inner wall surface of the casing, toward the driving means. In this way, it is possible to suppress air from flowing backward to a suction port through a gap between the shroud and the bell-mouth ring. Accordingly, it is possible to reduce the noise generated by an interference of the air sucked from the suction port with the air flowing backward or by the turbulence of the air flow which is generated in the gap.

7 Claims, 5 Drawing Sheets

CENTRIFUGAL BLOWER HAVING A BELL-MOUTH RING FOR REDUCING NOISE

CROSS REFERENCE TO THE RELATED APPLICATION

This application is based on and claims priority of Japanese Patent Application No. Hei. 8-53351 filed on Mar. 11, 1996, the content of which is incorporated herein by reference.

BACKGROUND OF THE INVENTION

1. Field of the Invention

The present invention relates to a centrifugal blower and is preferably employed in an air conditioning apparatus for a vehicle.

2. Description of Related Art

As is known well, a centrifugal blower (hereinafter referred to as a blower) includes a centrifugal multi-blade fan (hereinafter referred to as a fan) having a plurality of blades provided around a rotation axis thereof; a casing having an air suction port and an air discharge port and formed in a spiral shape; and driving means such as a motor for driving the fan. Performances of air blowing capacity, noise, and the like depend greatly on the shape of the blades of the fan, the casing, and the like. Thus, it is necessary to consider these factors when designing the blower.

In order to reduce the noise of the blower, as disclosed in JP-A-5-296194, the inventors of the present invention have experimentally manufactured and examined various fans each having a shroud, in which a cross sectional shape of the shroud in the axial direction of the rotation axis of the fan extends along the direction in which air flow deflects outwardly in a radial direction of the suction port of the fan; however, a desirable effect for reducing the noise cannot be obtained. As a result of further examinations by the inventors, the following points have been clarified.

That is, one of causes of generating noise is a turbulence of air flow, which is generated by a separation phenomenon between the blade and the air flowing between the adjacent blades. The separation phenomenon between the blade and the air flowing between the adjacent blades can be suppressed by providing a shroud having a shape along the direction of air flow so that air flowing between the adjacent blades becomes substantially uniform. Further, it has been confirmed by further examinations that the more the air (flow) separation phenomenon can be suppressed, the larger the ratio of the area of the shroud to that of the blade becomes, i.e., as shown in FIG. 9, in accordance with a decrease in the ratio (h2/h1) of the height h2 of the blade 71 at the outer-diameter side to the height h1 of the blade 71 at the inner-diameter side, the air (flow) separation phenomenon can be suppressed more.

As shown in FIG. 9, in accordance with an increase in the ratio of the area of the shroud 77 to that of the blade, air is more likely to be blown from a fan 72 toward an inner wall surface 74*c* of the casing 74 located at a side of a motor 73. Consequently, a part of the air blown out from the fan 72 flows along a vertical inner wall surface 74*d* of the casing 74 and an inner wall surface 74*b* of the casing 74 located at the side in which a suction port 75 is positioned. Accordingly, the air which has flowed along the inner wall surface 74*b* of the casing 74 flows backward from a gap 77*c* between the shroud 77 and the casing 74 toward the suction port 75. Consequently, noises are generated by an interference of air sucked by the suction port 75 with the air flowing backward to the suction port 75 or by a turbulence of air flow, which is generated when air flows backward through the gap 77*c* between the shroud 77 and the casing 74.

That is, by adding the shroud 77, it is possible to reduce the noise due to the separation phenomenon between the blade 71 and the air flowing between the adjacent blades 71; however, the air flows backward through the gap 77*c* between the shroud 77 and the casing 74. As a result, the noise as a whole of the blower may be increased. Further, another cause of generating noise is that the air is separated at the lower end portion of the shroud 77, and a swirl of the air is generated.

SUMMARY OF THE INVENTION

It is accordingly an object of the present invention to provide a centrifugal blower, capable of reducing the noise generated by the centrifugal blower while preventing a separation phenomenon between a blade of a centrifugal multi-blade fan and air flowing between adjacent blades.

In order to achieve the above object, the following technical means are preferably used.

According to the present invention, a bell-mouth ring is formed with a casing, proximately at an outer radial side of a shroud. The bell-mouth ring has a deflection wall surface for deflecting a flow of air blown radially outwardly from the centrifugal multi-blade fan and further flowing radially inwardly toward the rotation axis along an inner wall surface of the casing, toward the driving means.

In this way, it is possible to suppress air from flowing backward to a suction port through a gap between the shroud and the bell-mouth ring, because air flows along the bell-mouth ring. Accordingly, it is possible to reduce the noise generated by the interference of the air sucked from the suction port with the back-flow air or by the turbulence of the air flow generated in the gap.

An angle formed between the deflection wall surface and the inner wall surface of the casing at a side of a suction port may be in the range from 20° to 60°.

In this way, as will be described later, because air flowing backward is deflected without excessively disturbing the air flow in the air path, it is possible to suppress the air from flowing backward to reduce the noise.

Further, the distance between an end portion of the bell-mouth ring at a side of the driving means and the suction port may be shorter than the distance between an end portion of the shroud at a side of the driving means and the suction port.

It is possible to further suppress air blown out from the centrifugal multi-blade fan from interfering with the end portion of the bell-mouth ring at a side of the driving means to reduce the noise.

Still further, the bell-mouth ring may be formed in a range from a winding-start portion of the casing to a winding-termination portion of the casing.

In this way, it is possible to blow air toward the air outlet without generating a turbulence of the air flow and to prevent the air from flowing backward to the suction port.

Still further, the distance between the adjacent blades may increase gradually in an outward radial direction of the centrifugal multi-blade fan.

In this way, as will be described later, it is possible to reduce the consumed energy of the centrifugal blower as well as the noise.

Moreover, it is preferable that a ratio of a height (h2) of the centrifugal multi-blade fan at an outlet side, between an end portion of the blade at a side of the driving means and an end portion of the shroud at a side of the driving means, to a height (h1) of the centrifugal multi-blade fan at an inlet side, between an end portion of the blade at a side of the driving means and an end portion of the blade at a side of the suction port, is equal to 0.9 or less.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PRESENTLY PREFERRED EMBODIMENTS

A first embodiment of the present invention will be described.

Figure 1:
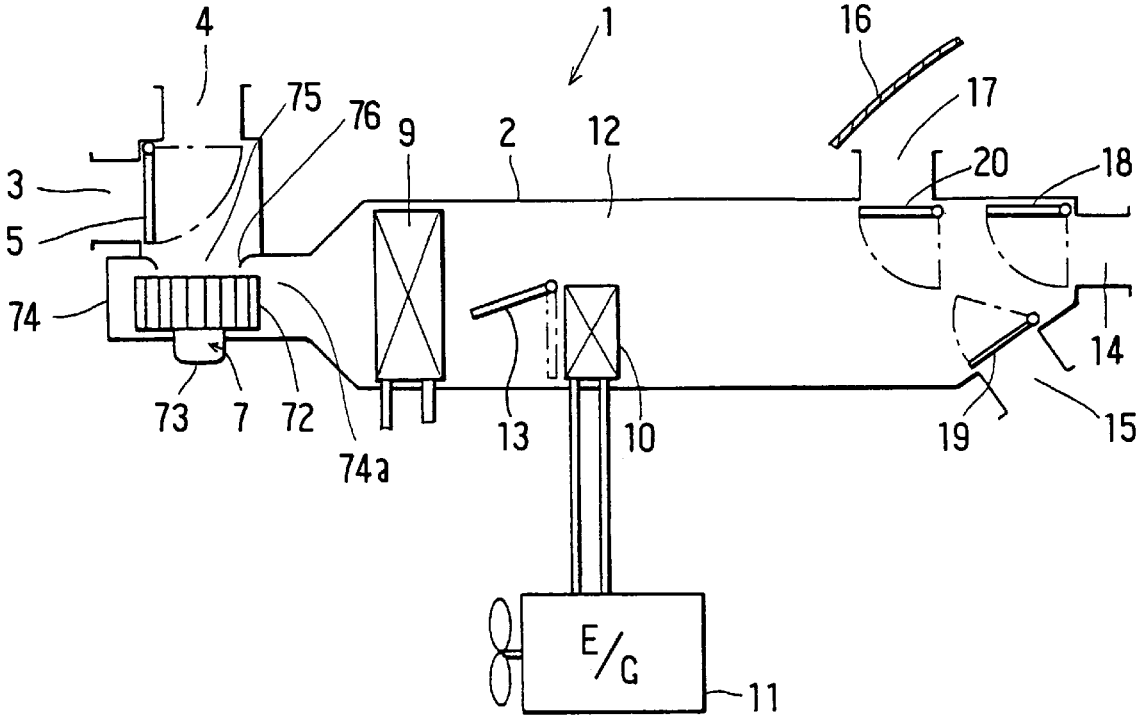
FIG. 1 is a block diagram in which a centrifugal blower according to the present invention is applied to an air conditioning apparatus for a vehicle.

FIG. 1 is a block diagram in which a centrifugal blower (hereinafter referred to as "a blower") according to the first embodiment of the present invention is applied to an air conditioning apparatus 1 for a vehicle having a water-cooled engine mounted thereon.

The air conditioning apparatus 1 includes an inside air suction port 3 for sucking air from inside a passenger compartment; an outer air suction port 4 for sucking outside air; and a switching door 5 for selectively opening and closing the inside air suction port 3 and the outer air suction port 4. The switching door 5 is opened and closed by driving means such as a servo motor or a manual operation.

The blower 7 is disposed at a downstream side of the switching door 5 and blows air sucked from both of the inside air suction port 3 and the outside air suction port 4 toward air outlets 14, 15, and 17 (described later). An evaporator 9 serving as air-cooling means is located at the air downstream side of the blower 7. Air blown by the blower 7 passes through the evaporator 9. A heater core 10 serving as air-heating means is located at an air downstream side of the evaporator 9. The heater core 10 heats air by using cooling water for cooling an engine 11 as its heat source.

In the air conditioning casing 2, there is formed a bypass path 12 bypassing the heater core 10 and an air-mixing door 13 positioned at an upstream side of the heater core 10. The air-mixing door 13 adjusts a ratio between the amount of air passing through the heater core 10 and that of air passing through the bypass path 12 by adjusting an opening degree of the air-mixing door 13.

At the most-downstream side of the air conditioning casing 2, there are formed a face air outlet 14 for blowing out conditioned air to an upper half of a passenger inside the passenger compartment; a foot air outlet 15 for blowing out air to the feet of the passenger; and a defroster air outlet 17 for blowing out air to an inner surface of a front windshield 16.

Air outlet mode switching doors (air outlet adjusting means) 18, 19, and 20 are provided at air upstream sides of the face air outlet 14, the foot air outlet 15, and the defroster air outlet 17, respectively. The air outlet mode switching doors 18, 19, and 20 are opened and closed by driving means such as a servo motor or a manual operation.

A structure of the blower will be described below in detail with reference to FIG. 2.

The centrifugal blower 7 sucks air in the axial direction of a rotation axis and blows out the sucked air radially outwardly. The blower 7 includes a centrifugal multi-blade fan 72 (hereinafter referred to as "a fan") having a plurality of blades 71 disposed around the rotation axis. The fan 72 is driven by driving means 73 (hereinafter referred to as "a motor"). The amount of air is controlled by controlling the rotational speed of the motor 73.

Figure 3:
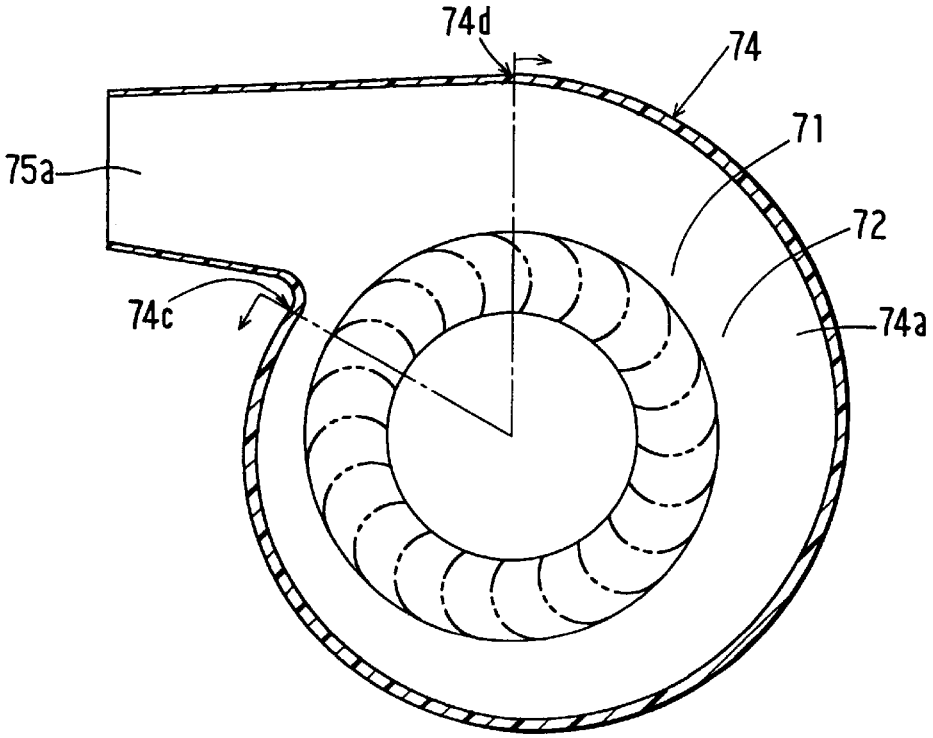
FIG. 3 is a cross sectional plan view of the centrifugal blower shown in of FIG. 2.

As shown in FIG. 3, a casing 74 made of resin such as polypropylene is formed spirally around the rotation axis of the fan 72. The casing 74 accommodates the fan 72 and constitutes an air path 74*a* in which air blown out from the fan 72 flows. An air outlet 75*a* communicating with the air conditioning casing 2 is formed at an air downstream side of a winding-termination portion 74*d* of the casing 74. A suction port 75 for introducing air into the casing 74 is opened in the casing 74 in the axial direction at a side opposite to a side at which the motor 73 is positioned. A bell-mouth 76 is formed around a peripheral edge of the suction port 75 of the casing 74. Air sucked by the suction port 75 is smoothly introduced toward the blades 71 by means of the bell-mouth 76.

An annular shroud 77 is formed on an end portion 71*a* of each blade 71 positioned at the suction port side. The shape of the shroud 77 in the axial direction is formed along a direction in which air flow sucked from the suction port 75 deflects radially outwardly. On the shroud 77, there is formed a projection 77*a* which protrudes from the upper end portion 71*a* of the blade 71 and extends toward the suction port 75. The bell-mouth 76 is curvedly formed outward from the peripheral edge of the suction port 75 to the end portion 71*a* of the blade 71 in such a manner that the bell-mouth 76 surrounds the projection 77*a* of the shroud 77.

A bell-mouth ring 78 having a deflection wall surface 78*a* is formed integrally with the casing 74 proximately at an outer radial side of the shroud 77. The deflection surface 78*a* deflects air blown out radially outwardly from the fan 72 and flowing radially inwardly toward the rotation axis along an inner wall surface 74*b* of the casing 74, toward the motor 73.

Figure 2:
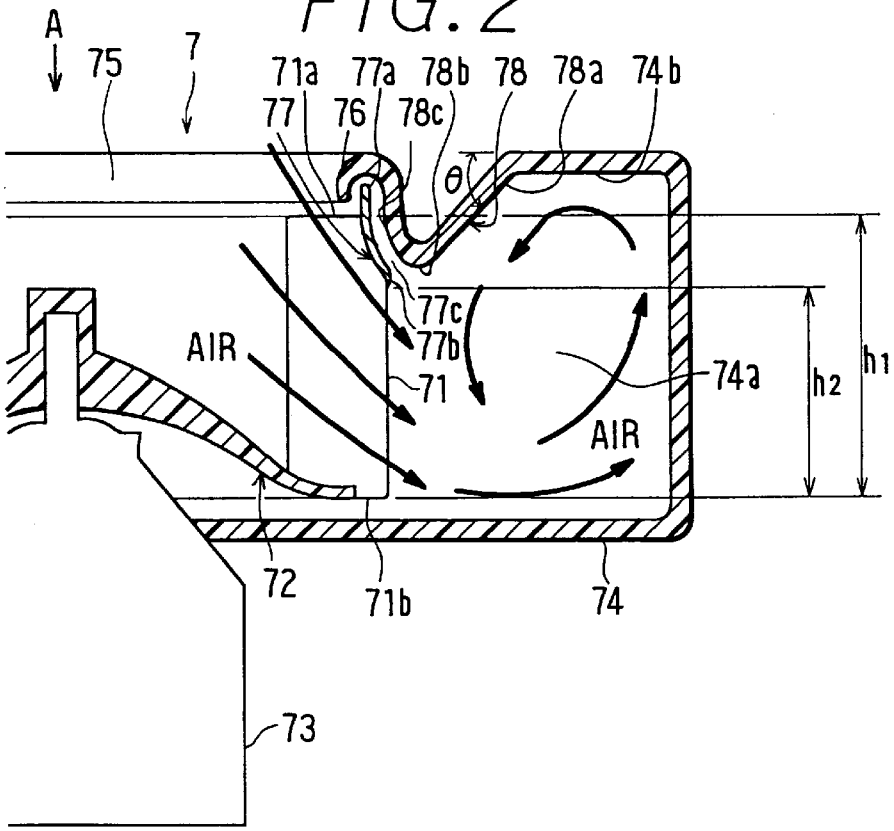
FIG. 2 is a cross sectional view showing a centrifugal blower according to a first embodiment of the present invention.

Referring to FIGS. 2 and 3, the bell-mouth ring 78 is formed in the range from a winding-start portion 74*c* of the casing 74 to a winding-termination portion 74*d* thereof in such a manner that the distance between an end portion 78*b* of the bell-mouth ring 78 at the side of the motor and the suction port 75 is shorter than the distance between an end portion 77*b* of the shroud 77 at the side of the motor and the suction port 75.

A surface 78*c* of the bell-mouth ring 78, facing the shroud 77, is curved such that a gap 77*c* between the shroud 77 and the surface 78*c* is almost constant. The gap 77*c* may be appropriately altered according to a specification of the fan 72. In the first embodiment, the gap 77*c* is set to about 3 mm.

Features of the first embodiment will be described below.

Since the deflection wall surface 78*a* is formed proximately at an outer radial side of the shroud 77, after having been blown radially outwardly from the fan 72, air flowing radially inwardly along the inner wall surface 74*b* of the casing 74 is deflected toward the motor 73 by means of the deflection wall surface 78*a*. Therefore, the air is prevented from flowing backward to the suction port 75 through the gap 77*c* between the shroud 77 and the surface 78*c* of the bell-mouth ring 78. That is, the air flowing radially inwardly (back-wardly) along the inner wall surface 74*b* of the casing 74 is prevented from flowing further backward (radially inwardly). Accordingly, the interference between air sucked by the suction port 75 and the air flowing radially inwardly, namely, toward the rotation axis of the blower 7, is reduced and raise is decreased. Further, no turbulence of the air flow is generated in the gap 77*c*, because the back-flow air is prevented from flowing thereinto. Thus, it is possible to reduce the noise due to the turbulence of the air flow.

Since the deflection surface 78*a* deflects the back-flow air toward the motor 73 to suppress the air from flowing backward into the gap 77*c*, it is necessary to deflect air flowing in the air path 74*a* toward the motor 73 without being disturbed excessively.

Figure 4:
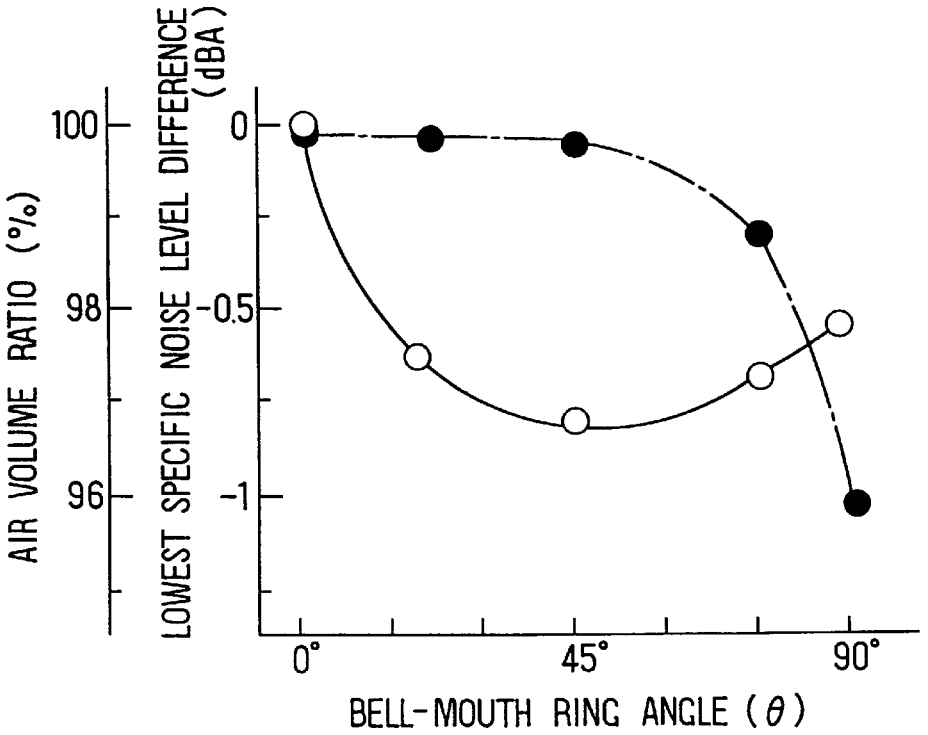
FIG. 4 is a graph showing a relationship between a bell-mouth ring angle and the minimum specific noise level as well as a ratio of an air amount.

To overcome this problem, resulting from research and examinations by inventors for the relationship between an angle θ (hereinafter referred to as "a bell-mouth ring angle") formed between the deflection wall surface 78*a* of the casing 74 and the inner wall surface 74*b* thereof positioned at the suction port-positioned side and a specific noise level Ks, the result as shown in FIG. 4 is obtained. The solid line shown in FIG. 4 indicates a difference between specific noise levels obtained by varying the bell-mouth ring angle θ and the minimum specific noise level which is the reference noise level at the time when the bell-mouth ring angle θ is 0 (i.e., when bell-mouth ring is not provided). The one-dot chain line shown in FIG. 4 indicates a ratio (percentage) between an amount of the air blown out from the air outlet 75*a* obtained by varying the bell-mouth ring angle θ, with the rotational speed of the fan 72 maintained at a predetermined value, and the reference amount of air blown out from the air outlet 75*a* at the time when the bell-mouth ring angle θ is 0.

As shown in FIG. 4, the specific noise level is the minimum when the bell-mouth ring angle θ is 45°, whereas there is almost no decrease in the amount of the air when the bell-mouth ring angle θ is in the range from 0° to 45°. Accordingly, considering that the blower of the first embodiment is installed on an air conditioning apparatus for a vehicle, preferably, the bell-mouth ring angle θ is in the range from 20° to 60°. In the first embodiment, the bell-mouth ring angle θ is set to 45°.

The distance between an end portion 78*b* of the bell-mouth ring 78 positioned at the side of the motor and the suction port 75 is shorter than the distance between an end portion 77*b* of the shroud 77 positioned at the side of the motor and the suction port 75. Thus, the air blown radially outwardly from the fan 72 is prevented from interfering with the end portion 78*b* of the bell-mouth ring 78.

Since the noise generated by the interference of the air with the end portion 78*b* is suppressed, it is possible to reduce the noise.

Because the bell-mouth ring 78 is formed from the winding-start portion 74*c* of the casing 74 to the winding-termination portion 74*d*, the bell-mouth ring 78 can introduce air to the air outlet 75*a* without generating a turbulence of the air flow and can suppress the air from flowing backward to the suction port 75.

Because the projection 77*a* extends from the end 71*a* of each blade 71 toward the suction port side and the bell-mouth 76 surrounds the projection 77*a*, air flowing radially inwardly (backward) can be suppressed from being introduced into the gap 77*c* and flowing into the suction port 75. Thus, the air can be further suppressed from flowing from the air path 74*a* to the suction port 75.

A second embodiment of the present invention will be described.

In the second embodiment, while the noise is reduced by using the shroud 77 and the bell-mouth ring 78, consumed energy (specifically, consumed electric power) of the blower is reduced.

Figure 5:
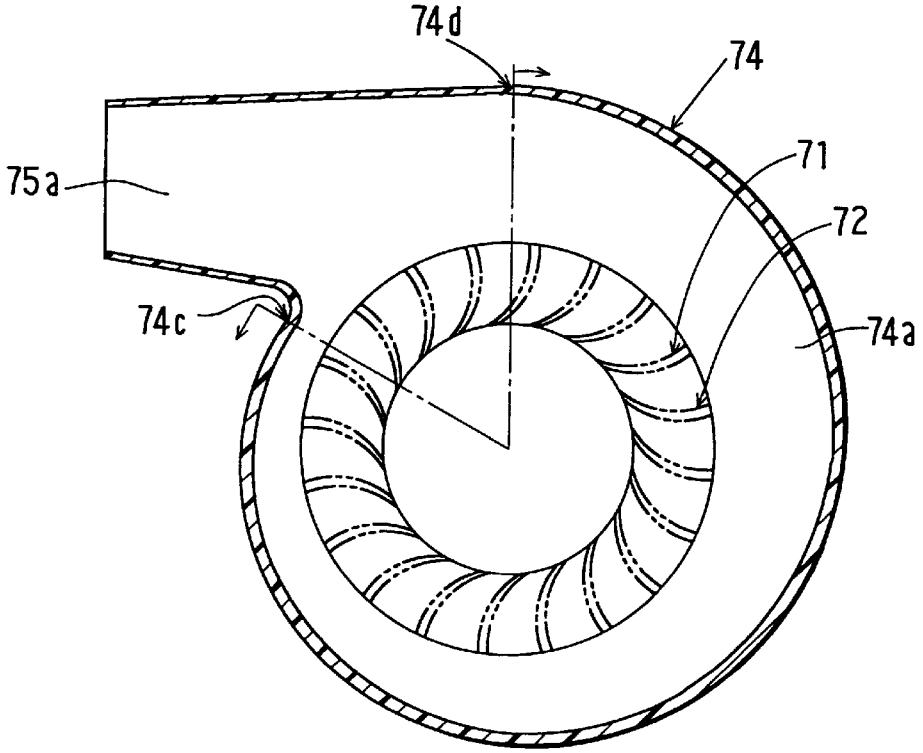
FIG. 5 is a cross sectional view showing a centrifugal blower according to a second embodiment of the present invention.

More specifically, as shown in FIG. 5, the distance between the adjacent blades 71 is set to be gradually larger in the outward radial direction of the fan 72 so that the rotational speed of the motor, having a high efficiency, can be set to be coincident with that of the fan 72, having a high air blowing capacity. In this manner, the consumed energy of the blower can be reduced.

It is generally known that the separation phenomenon between the blade 71 and the air flowing between the adjacent blades 71 is more likely to occur when the distance between the adjacent blades 71 is set to be gradually larger in the outward radial direction. As described previously, the air separation phenomenon can be increasingly suppressed in accordance with an increase in the ratio of the area of the shroud 77 to that of the blade 71, i.e., in accordance with a decrease in the ratio (h2/h1) of the height h2 (height of blade at the outer-diameter side) of the fan 72 at an outlet side, namely, the distance between the (lower) end portion 71*b* of the blade 71 at the side of the motor and the end portion 77*b* of the shroud 77 at the side of the motor, to the height h1 (height of blade at the inner-diameter side) of the fan 72 at an inlet side, namely, the distance between the end 71*b* of the blade 71 and the end portion 71*a* at the side of the suction port, as shown in FIG. 2.

As described previously, in accordance with an increase in the ratio of the area of the shroud 77 to that of the blade 71, noise is generated by the air flowing radially inwardly (backwardly). To prevent the noise from being generated, the bell-mouth ring 78 is provided proximately at an outer radial side of the shroud 77. In this way, it is possible to reduce the noise generated by the interference of the air sucked from the suction port 75 with the back-flow air or by the turbulence of the air flow generated in the gap 77*c*.

Resulting from further research by the inventors on the relationship between the ratio (h2/h1) of the area of the shroud 77 to that of the blade 71 and noise, the following result has been obtained.

Figure 6:
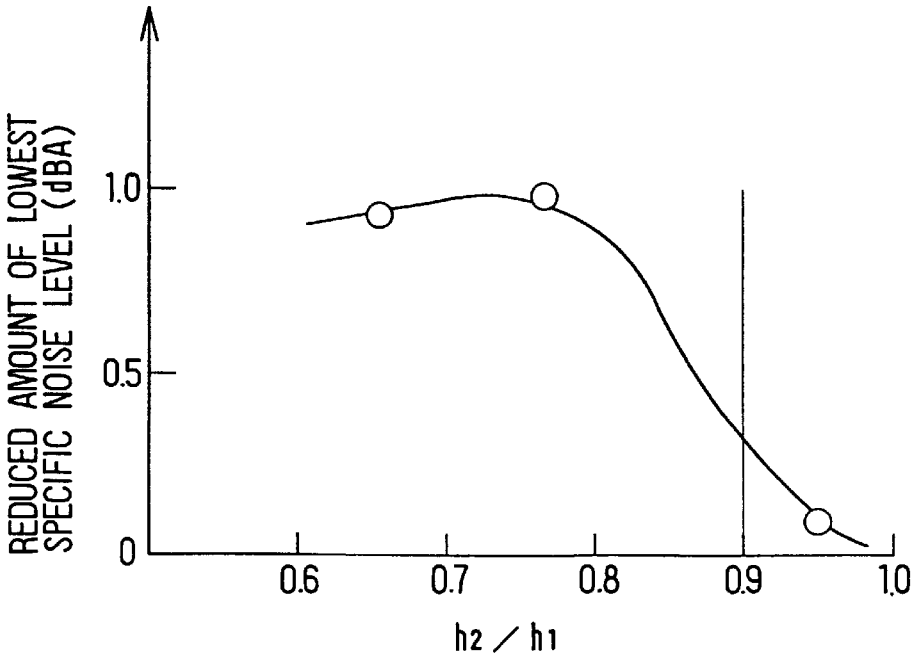
FIG. 6 is a graph showing a relationship between a ratio (h2/h1) of an area of a shroud to that of a blade and the minimum specific noise level.

FIG. 6 indicates the difference (reduced amount of the minimum specific noise level) between the minimum specific noise level at the time when the bell-mouth ring angle θ is 45° and the minimum specific noise level at the time when the bell-mouth ring is not provided, by varying the ratio (h2/h1) of the area of the shroud 77 to that of the blade 71. As shown in FIG. 6, when the ratio (h2/h1) of the area of the shroud 77 to that of the blade 71 is 0.9 or less, it turns out that a remarkable effect for reducing the noise by the bell-mouth ring 78 can be obtained. Accordingly, when the ratio (h2/h1) of the area of the shroud 77 to that of the blade 71 is 0.9 or less, the noise can be effectively reduced by employing both the bell-mouth ring 78 and the shroud 77.

Figure 7:
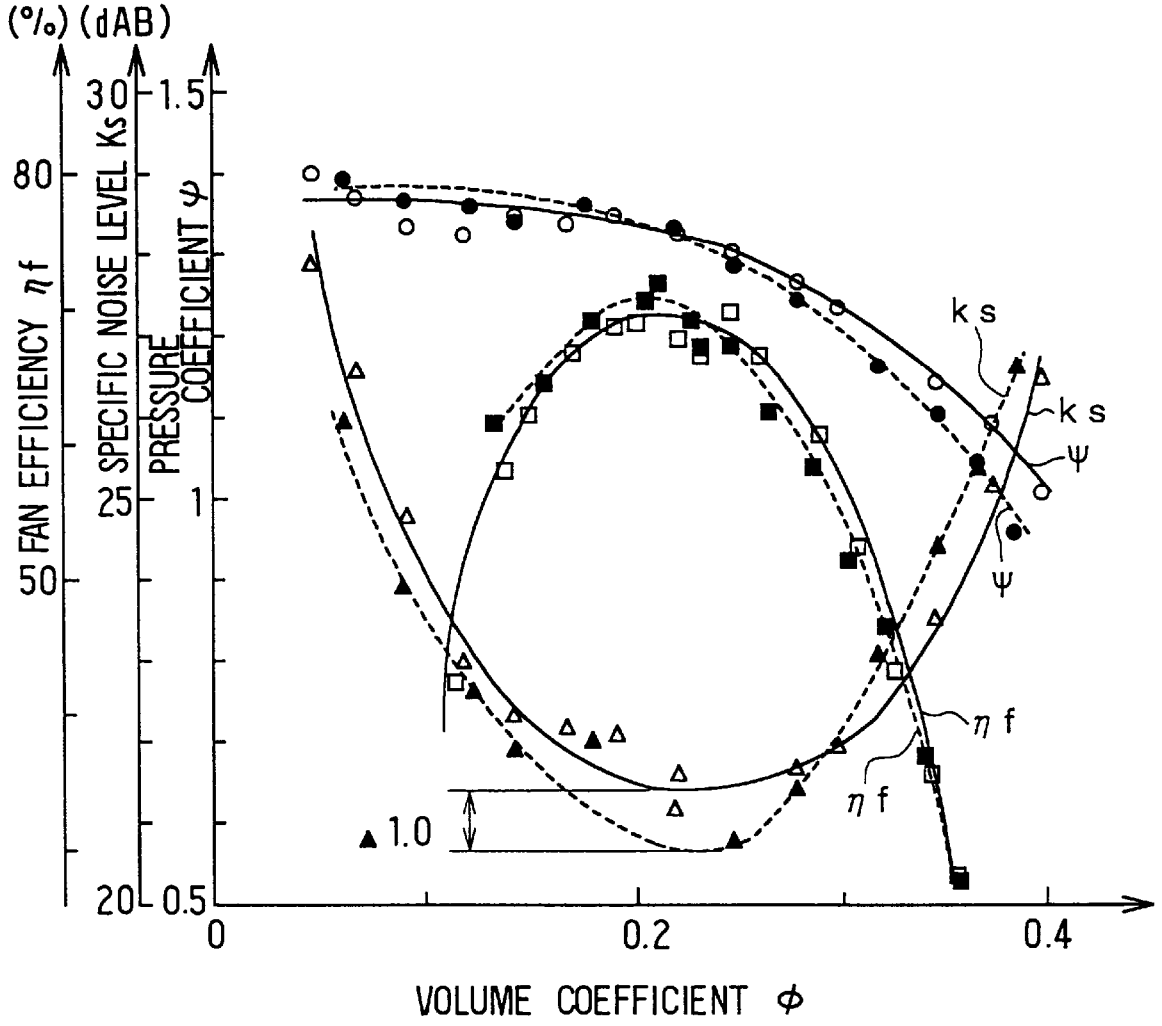
FIG. 7 is a graph showing test results to compare an efficiency and a specific noise level of the centrifugal blower according to the second embodiment of the present invention and a conventional type.

FIG. 7 shows a test result obtained by examining the relationship between the flow coefficient $\phi$ and the efficiency $\eta$, the specific noise level Ks, and the pressure coefficient $\psi$ of the blower of the second embodiment and the conventional blower. As shown in FIG. 7, the efficiency $\eta$ and the specific noise level Ks of the blower according to the second embodiment are improved as compared with the conventional blower. For example, the minimum specific noise level of the blower according to the second embodiment is lower than the conventional blower by about 1 dBA in the condition that the outer diameter of fans used in the test is 145 mm, the height h1 is 65 mm, and a voltage of 12 is applied to motors. The test is performed in accordance with the method defined in JIS (Japanese Industrial Standard) B 8330.

The state where the flow coefficient $\phi$ is large corresponds to the one where the pressure loss is small, for example, in a face mode in which air is blown out toward an upper half of a body of a passenger. The state where the flow coefficient $\phi$ is small corresponds to the one where the pressure loss is large, for example, in a foot mode in which air is blown out toward feet of the passenger.

Figure 8:
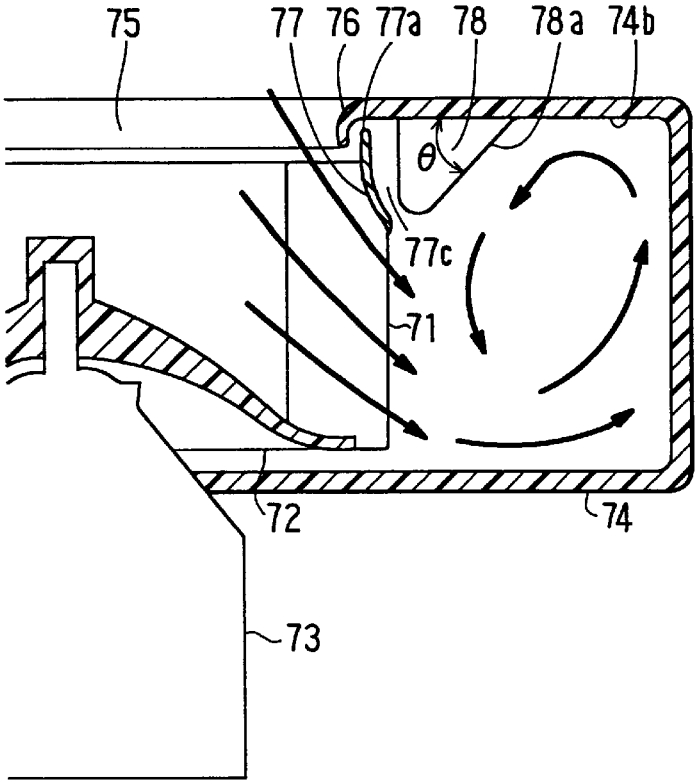
FIG. 8 is a cross sectional view showing a centrifugal blower provided with a bell-mouth ring according to a modification of the present invention.
Figure 9:
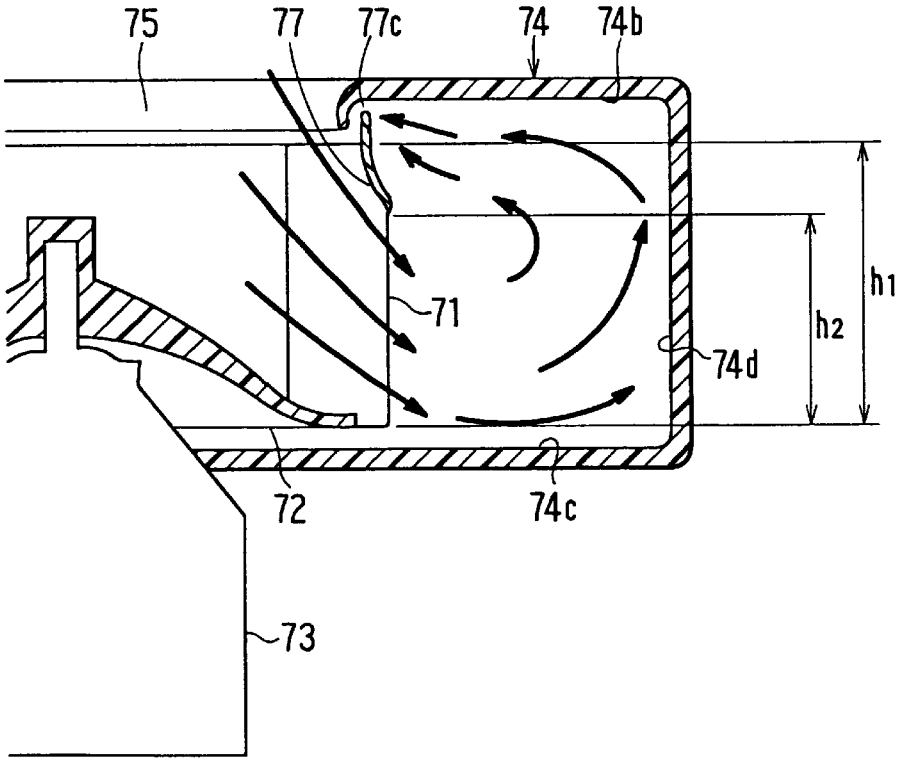
FIG. 9 PRIOR ART
FIG. 9 is a cross sectional view showing a conventional centrifugal blower.

It is not always necessary for the gap 77*c* between the shroud 77 and the surface 78*c* of the bell-mouth ring 78 to be constant. As shown in FIG. 8, the gap 77*c* may be altered partially.

The bell-mouth ring 78 may be manufactured separately from the casing 74, and these are assembled together later.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A centrifugal blower comprising:

a centrifugal multi-blade fan having a plurality of blades around a rotation axis thereof, said multi-blade fan sucking air axially from a suction port side and blowing the sucked air radially outwardly;

a casing for accommodating said centrifugal multi-blade fan and forming an air path for said air blown from said centrifugal multi-blade fan, said casing being formed in a spiral shape around said rotation axis of said centrifugal multi-blade fan and having a suction port opened at said suction port side;

driving means disposed at a driving means side of said multi-blade fan for driving said centrifugal multi-blade fan;

an annular shroud formed on said blades at said suction port side and having a cross sectional shape along a flow of air deflecting radially outwardly from said suction port, said annular shroud including a projection protruding from an upper end portion of said blades and extending toward said suction port;

a bell-mouth opening formed on said casing in such a manner that it curves outwardly from a peripheral edge of said suction port to the upper end portion of said blades to surround said projection of the annular shroud;

a bell-mouth ring disposed proximately at an outer radial side of said shroud and having a deflection wall surface for deflecting a flow of air blown radially inwardly toward said rotation axis along an inner wall surface of a suction port side wall of said casing toward said driving means, wherein said bell-mouth ring is formed on said suction port side wall of said casing in such a manner that the deflection wall surface slants from the suction port side toward the driving means side radially inwardly; and said bell-mouth ring has a surface facing said annular shroud which is curved such that a gap between said shroud and said surface is substantially constant.

2. A centrifugal blower according to claim 1, wherein an angle formed between said deflection wall surface and said inner wall surface of said suction port sidewall of the casing is in a range from 20° to 60°.

3. A centrifugal blower according to claim 1, wherein a distance between an end portion of said bell-mouth ring and said suction port is shorter than a distance between an end portion of said shroud and said suction port.

4. A centrifugal blower according to claim 1, wherein, said casing includes a winding-start portion and a winding-termination portion at end portions of said spiral shape, respectively, said casing further includes an air outlet opened at said winding-termination portion, for blowing out air outside said casing, and said bell-mouth ring is formed from said winding-start portion to said winding-termination portion.

5. A centrifugal blower according to claim 1, wherein a distance between the adjacent blades increases in an outward radial direction of said centrifugal multi-blade fan.

6. A centrifugal blower according to claim 1, wherein a ratio of a height (h2) of said blades of said centrifugal multi-blade fan at an outlet side to a height (h1) of said blades of said centrifugal multi-blade fan at an inlet side is equal to 0.9 or less.

7. A centrifugal blower comprising:

a centrifugal multi-blade fan having a plurality of blades around a rotation axis thereof, said multi-blade fan sucking air axially from a suction port side and blowing the sucked air radially outwardly;

a casing for accommodating said centrifugal multi-blade fan and forming an air path for said air blown from said centrifugal multi-blade fan, said casing being formed in a spiral shape around said rotation axis of said centrifugal multi-blade fan and having a suction port opened at said suction port side;

driving means disposed at a driving means side of said multi-blade fan for driving said centrifugal multi-blade fan;

an annular shroud formed on said blades at said suction port side and having a cross sectional shape along a flow of air deflecting radially outwardly from said suction port, said annular shroud including a projection protruding from an upper end portion of said blades and extending toward said suction port;

a bell-mouth opening formed on said casing in such a manner that it curves outwardly from a peripheral edge of said suction port to the upper end portion of said blades to surround said projection of the annular shroud;

a ring member disposed proximately at an outer radial side of said shroud and having a deflection wall surface for deflecting a flow of air blown radially inwardly toward said rotation axis along an inner wall surface of a suction port side wall of said casing toward said driving means, wherein said ring member is formed on said suction port side wall of said casing in such a manner that the deflection wall surface slants from the suction port side toward the driving means side radially inwardly; and said ring member has a surface facing said annular shroud which is curved such that a gap between said shroud and said surface is substantially constant.

* * * * *